US010760824B2

(12) United States Patent
Akaiwa et al.

(10) Patent No.: US 10,760,824 B2
(45) Date of Patent: Sep. 1, 2020

(54) HEAT EXCHANGER AND REFRIGERATION CYCLE APPARATUS

(71) Applicant: Mitsubishi Electric Corporation, Tokyo (JP)

(72) Inventors: Ryota Akaiwa, Tokyo (JP); Shinya Higashiiue, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/775,130

(22) PCT Filed: Dec. 17, 2015

(86) PCT No.: PCT/JP2015/085362

§ 371 (c)(1),
(2) Date: May 10, 2018

(87) PCT Pub. No.: WO2017/104050

PCT Pub. Date: Jun. 22, 2017

(65) Prior Publication Data

US 2018/0328627 A1 Nov. 15, 2018

(51) Int. Cl.
*F25B 5/02* (2006.01)
*F28D 1/04* (2006.01)
(Continued)

(52) U.S. Cl.
CPC ..... *F25B 5/02* (2013.01); *F25B 13/00* (2013.01); *F25B 39/00* (2013.01); *F25B 47/025* (2013.01);
(Continued)

(58) Field of Classification Search
CPC .. F25B 5/02; F25B 13/00; F25B 39/00; F28D 1/0452; F28D 1/053
See application file for complete search history.

(56) References Cited

U.S. PATENT DOCUMENTS 5,086,835 A * 2/1992 Shinmura ..... F28D 1/0435 123/41.51
5,381,665 A * 1/1995 Tanaka ..... F25B 31/008 62/197
(Continued)

FOREIGN PATENT DOCUMENTS

DE 11 2012 005 066 T5 9/2014
EP 2 314 957 A2 4/2011
(Continued)

OTHER PUBLICATIONS

Extended European Search Report dated Nov. 30, 2018 issued in corresponding EP patent application No. 15910740.8.
(Continued)

*Primary Examiner* — Jon T. Schermerhorn, Jr.
(74) *Attorney, Agent, or Firm* — Posz Law Group, PLC

(57) ABSTRACT

A heat exchanger includes: a plurality of first heat transfer tubes, a plurality of second heat transfer tubes located on leeward side relative to the plurality of first heat transfer tubes, a first distribution unit connecting the first ends of the plurality of first heat transfer tubes and the third ends of the plurality of second heat transfer tubes. The first distribution unit includes a flow rate control unit configured to be capable of switching between a first state and a second state. In the first state, refrigerant flows in the plurality of first heat transfer tubes and the plurality of second heat transfer tubes. In the second state, in only the plurality of first heat transfer tubes, a flow rate of the refrigerant is smaller than a flow rate of the refrigerant in the first state.

8 Claims, 6 Drawing Sheets

(51) Int. Cl.

| | |
|---|---|
| ***F25B 13/00*** | (2006.01) |
| ***F28F 1/12*** | (2006.01) |
| ***F25B 39/00*** | (2006.01) |
| ***F28D 1/053*** | (2006.01) |
| ***F28F 1/30*** | (2006.01) |
| ***F28F 19/00*** | (2006.01) |
| ***F28F 17/00*** | (2006.01) |
| ***F28F 27/02*** | (2006.01) |
| ***F25B 47/02*** | (2006.01) |
| *F28D 21/00* | (2006.01) |

(52) U.S. Cl.

CPC ..... *F28D 1/0452* (2013.01); *F28D 1/053* (2013.01); *F28D 1/05391* (2013.01); *F28F 1/128* (2013.01); *F28F 1/30* (2013.01); *F28F 17/00* (2013.01); *F28F 17/005* (2013.01); *F28F 19/006* (2013.01); *F28F 27/02* (2013.01); *F25B 2313/0294* (2013.01); *F28D 2021/0068* (2013.01); *F28F 2215/02* (2013.01)

(56) References Cited

U.S. PATENT DOCUMENTS

| | | | | |
|---|---|---|---|---|
| 5,678,761 | A * | 10/1997 | Ikeda | B60H 1/00007 237/12.3 A |
| 6,170,565 | B1 * | 1/2001 | Nishishita | F28D 1/0435 165/135 |
| 2008/0202153 | A1 | 8/2008 | Watanabe | |
| 2011/0056668 | A1 * | 3/2011 | Taras | F28D 1/0478 165/174 |
| 2011/0113803 | A1 * | 5/2011 | Ahn | B60H 1/323 62/204 |
| 2014/0245767 | A1 * | 9/2014 | Miyakoshi | B60H 1/00785 62/159 |
| 2014/0290296 | A1 * | 10/2014 | Katoh | F28D 1/0452 62/238.7 |
| 2016/0082810 | A1 * | 3/2016 | Suzuki | B60H 1/00921 62/151 |

FOREIGN PATENT DOCUMENTS

| | | | |
|---|---|---|---|
| JP | S54-136458 | A | 10/1979 |
| JP | H02-140166 | U | 11/1990 |
| JP | H09-280754 | A | 10/1997 |
| JP | 2006-207994 | A | 8/2006 |
| JP | 2010-133613 | A | 6/2010 |
| JP | 2012-067971 | A | 4/2012 |
| JP | 2012-067985 | A | 4/2012 |
| WO | 2009/134760 | A2 | 11/2009 |

OTHER PUBLICATIONS

International Search Report of the International Searching Authority dated Mar. 15, 2016 for the corresponding international application No. PCT/JP2015/085362 (and English translation).

Office Action dated Jun. 3, 2019 issued in corresponding CN patent application No. 201580085248.5 (and English translation).

Office Action dated Jun. 11, 2019 issued in corresponding JP patent application No. 2017-556277 (and English translation).

Office Action dated Jan. 13, 2020 issued in corresponding CN patent application No. 201580085248.5 (and English translation).

Office Action dated Apr. 21, 2020 issued in corresponding CN patent application No. 201580085248.5 (and English translation).

* cited by examiner

HEAT EXCHANGER AND REFRIGERATION CYCLE APPARATUS

CROSS REFERENCE TO RELATED APPLICATION

This application is a U.S. national stage application of International Application No. PCT/JP2015/085362, filed on Dec. 17, 2015, the contents of which are incorporated herein by reference.

TECHNICAL FIELD

The present invention relates to a heat exchanger and a refrigeration cycle apparatus.

BACKGROUND

Conventionally, there has been known a heat exchanger including a pair of upper and lower headers horizontally facing each other, a plurality of flat heat transfer tubes communicatively connected to these headers such that the plurality of flat heat transfer tubes are in parallel with each other at a regular interval, and a corrugated fin interposed into a gap between the flat heat transfer tubes in close contact therewith. In the heat exchanger, refrigerant serving as a heat exchange medium flows in the plurality of flat heat transfer tubes simultaneously in parallel.

When heating operation is performed in a cold climate using such a heat exchanger as a heat pump-type outdoor unit for air conditioning for both cooling and heating, frost forms on surfaces of the fin and the heat transfer tubes, and heat exchange efficiency is decreased.

As a measure against such frost formation, Japanese Patent Laying-Open No. 9-280754 (PTD 1) discloses a heat exchanger including a corrugated fin disposed to protrude on windward side from flat heat transfer tubes, and louvers formed only in a leeward portion.

PATENT LITERATURE

PTD 1: Japanese Patent Laying-Open No. 9-280754

However, in the heat exchanger described in PTD 1, since the fin protrudes on the windward side relative to refrigerant flow paths (flat tubes), frost formation on the fin located on the windward side can be suppressed, but efficiency of defrosting frost on the fin is poor.

SUMMARY

The present invention has been made to solve the aforementioned problem. A main object of the present invention is to provide a heat exchanger which can suppress frost formation on a fin and has a high defrosting efficiency.

A heat exchanger in accordance with the present invention includes: a plurality of first heat transfer tubes disposed at intervals in a first direction and having respective first ends and respective second ends; a plurality of second heat transfer tubes disposed at a distance from the plurality of first heat transfer tubes to face the plurality of first heat transfer tubes in a second direction crossing the first direction, located on leeward side relative to the plurality of first heat transfer tubes, and having respective third ends and respective fourth ends; a plurality of fins connecting the first heat transfer tubes adjacent to each other and connecting the second heat transfer tubes adjacent to each other; a first distribution unit connecting the first ends of the plurality of first heat transfer tubes and the third ends of the plurality of second heat transfer tubes; and a second distribution unit connecting the second ends of the plurality of first heat transfer tubes and the fourth ends of the plurality of second heat transfer tubes. The first distribution unit includes a flow rate control unit configured to be capable of switching between a first state and a second state. In the first state, refrigerant flows in the plurality of first heat transfer tubes and the plurality of second heat transfer tubes. In the second state, in only the plurality of first heat transfer tubes, a flow rate of the refrigerant is smaller than a flow rate of the refrigerant in the first state.

According to the present invention, a heat exchanger which can suppress frost formation on a fin and has a high defrosting efficiency can be provided.

BRIEF DESCRIPTION OF DRAWINGS

FIG. 5(*b*) is a graph showing distribution of temperature of a surface of the fin shown in FIG. 5(*a*) and distribution of temperature of air passing over the surface at the time of heating operation. FIG. 5(*c*) is a graph showing distribution of the amount of heat exchange between the fin and the air on the fin shown in FIG. 5(*a*) at the time of heating operation.

DETAILED DESCRIPTION

Figure 1:
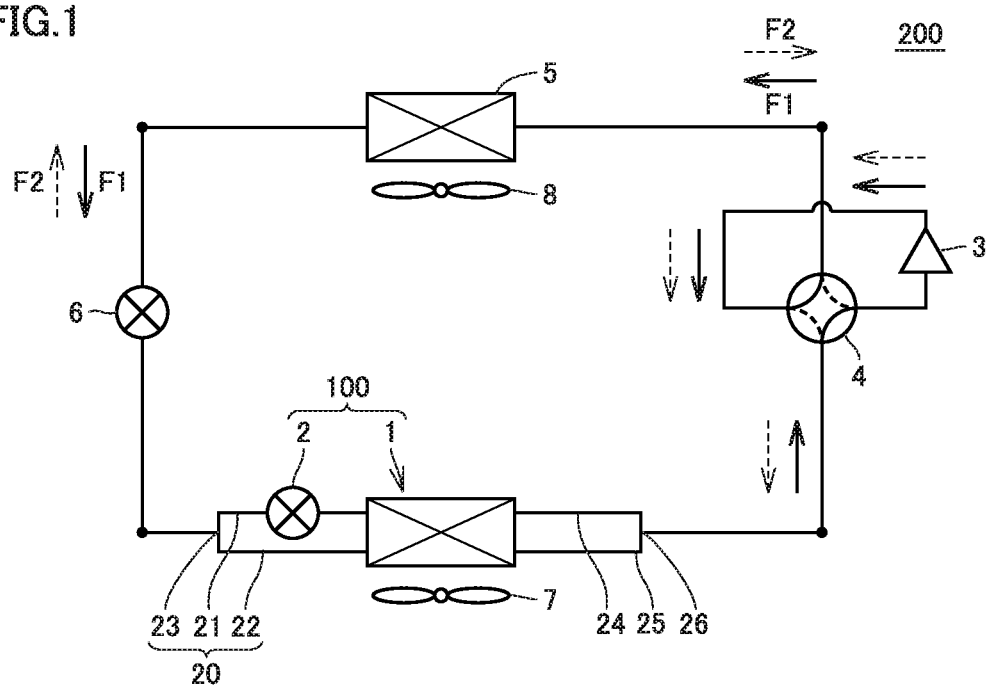
FIG. 1 is a view showing a heat exchanger and a refrigeration cycle apparatus in accordance with a first embodiment.

Hereinafter, embodiments of the present invention will be described with reference to the drawings. It should be noted that, in the drawings below, identical or corresponding parts will be designated by the same reference numerals, and the description thereof will not be repeated.

First Embodiment

<Refrigeration Cycle Apparatus>

First, a refrigeration cycle apparatus 200 in accordance with a first embodiment will be described with reference to FIG. 1. Refrigeration cycle apparatus 200 includes an outdoor heat exchanger 100, a compressor 3, a four-way valve 4, an indoor heat exchanger 5, an expansion valve 6, an outdoor fan 7, and an indoor fan 8. Outdoor heat exchanger 100, compressor 3, four-way valve 4, indoor heat exchanger 5, and expansion valve 6 are connected with one another to constitute a refrigerant circuit through which refrigerant circulates.

Outdoor heat exchanger 100 includes a heat exchanger main body unit 1 and an LEV (linear electronic expansion valve) 2 serving as a flow rate control unit (details thereof will be described later). Outdoor heat exchanger 100 is a heat exchanger disposed outside a space (room) in which air temperature is controlled by heating or cooling operation in refrigeration cycle apparatus 200. Outdoor heat exchanger 100 is disposed outside the room to perform heat exchange between the refrigerant and outdoor air. Indoor heat exchanger 5 is disposed inside the room to perform heat exchange between the refrigerant and indoor air. Outdoor heat exchanger 100 and indoor heat exchanger 5 are connected on one side via compressor 3 and four-way valve 4, and are also connected on the other side via expansion valve 6.

Compressor 3 has a suction side and a discharge side which are connected with four-way valve 4. Four-way valve 4 is provided to be capable of switching between refrigerant flow paths at the time of cooling operation and defrosting operation and at the time of heating operation. In FIG. 1, a solid line and arrows F1 indicate a refrigerant flow path at the time of heating operation, and a broken line and arrows F2 indicate a refrigerant flow path at the time of cooling operation and defrosting operation. Four-way valve 4 is provided to be capable of causing the refrigerant (having high temperature and high pressure) discharged from compressor 3 to flow out to indoor heat exchanger 5 at the time of heating operation. Four-way valve 4 is provided to be capable of causing the refrigerant having high temperature and high pressure discharged from compressor 3 to flow out to outdoor heat exchanger 100 at the time of cooling operation and defrosting operation. Expansion valve 6 expands the refrigerant flowing from indoor heat exchanger 5 to outdoor heat exchanger 100 at the time of heating operation. Expansion valve 6 expands the refrigerant flowing from outdoor heat exchanger 100 to indoor heat exchanger 5 at the time of cooling operation and defrosting operation. Fan 7 is provided to be capable of blowing air to outdoor heat exchanger 100 along a second direction B described later. Fan 8 is provided to be capable of blowing air to indoor heat exchanger 5.

<Outdoor Heat Exchanger>

Next, outdoor heat exchanger 100 will be described with reference to FIGS. 1 and 2. Outdoor heat exchanger 100 includes heat exchanger main body unit 1, a first distribution unit 20 having LEV 2, and a second distribution unit 24, 25, 26. Heat exchanger main body unit 1 includes a plurality of first heat transfer tubes 11, a plurality of second heat transfer tubes 12, and a plurality of fins 13 (details thereof will be described later). The plurality of first heat transfer tubes 11 are disposed at intervals in a first direction A. The plurality of first heat transfer tubes 11 have respective first ends and respective second ends located opposite to the respective first ends. The plurality of second heat transfer tubes 12 are disposed at intervals in first direction A. The plurality of second heat transfer tubes 12 are disposed at a distance from first heat transfer tubes 11 to face first heat transfer tubes 11 in second direction B crossing first direction A. The plurality of second heat transfer tubes 12 are located on leeward side relative to the plurality of first heat transfer tubes 11. The plurality of second heat transfer tubes 12 have respective third ends and respective fourth ends located opposite to the respective third ends. The first ends and the third ends are one ends in a third direction C (for example, a vertical direction) crossing first direction A and second direction B, and are lower ends of the plurality of first heat transfer tubes 11 and the plurality of second heat transfer tubes 12, for example. The second ends and the fourth ends are the other ends in third direction C, and are upper ends of the plurality of first heat transfer tubes 11 and the plurality of second heat transfer tubes 12, for example.

Figure 2:
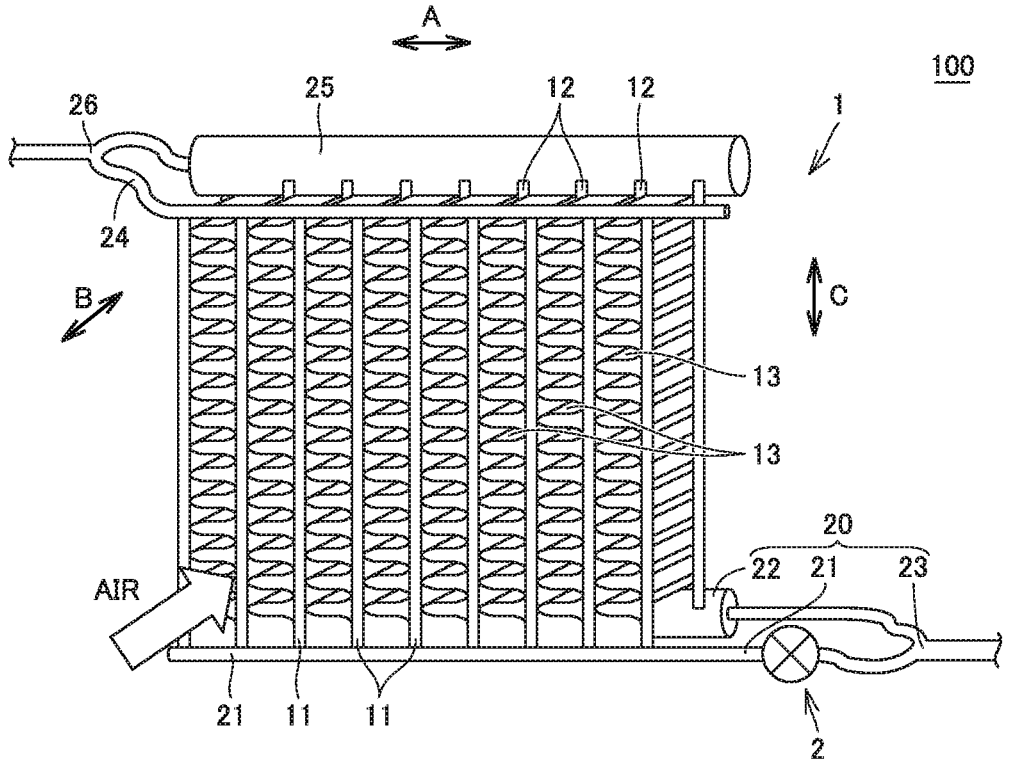
FIG. 2 is a schematic view showing the heat exchanger in accordance with the first embodiment.

As shown in FIG. 2, first distribution unit 20 connects the first ends of the plurality of first heat transfer tubes 11 and the third ends of the plurality of second heat transfer tubes 12. First distribution unit 20 includes a first distributor 21, a second distributor 22, and an inlet and outlet portion 23.

As shown in FIG. 2, first distributor 21 is connected with the first ends of the plurality of first heat transfer tubes 11. First distributor 21 is provided to extend along first direction A. The plurality of first heat transfer tubes 11 are connected to first distributor 21 such that the plurality of first heat transfer tubes 11 are in parallel with one another, and first distributor 21 is provided to be capable of distributing the refrigerant to the plurality of first heat transfer tubes 11.

As shown in FIG. 2, second distributor 22 is connected with the third ends of the plurality of second heat transfer tubes 12. Second distributor 22 is provided to extend along first direction A. The plurality of second heat transfer tubes 12 are connected to second distributor 22 such that the plurality of second heat transfer tubes 12 are in parallel with one another, and second distributor 22 is provided to be capable of distributing the refrigerant to the plurality of second heat transfer tubes 12.

Inlet and outlet portion 23 is located between a first connection portion and a second connection portion, the first connection portion being between first distributor 21 and the plurality of first heat transfer tubes 11, the second connection portion being between second distributor 22 and the plurality of second heat transfer tubes 12, and is provided to allow the refrigerant to flow in and out between first distributor 21 and second distributor 22.

At the time of heating operation, first distribution unit 20 acts as a bifurcating tube which distributes the refrigerant flowing through refrigeration cycle apparatus 200 into first distributor 21 and second distributor 22 in outdoor heat exchanger 100, and also acts as a distributor which distributes the refrigerant distributed into first distributor 21 and second distributor 22 to the plurality of first heat transfer tubes 11 and the plurality of second heat transfer tubes 12, respectively.

In first distribution unit 20, LEV 2 is provided between inlet and outlet portion 23 and the first connection portion between first distributor 21 and the plurality of first heat transfer tubes 11. LEV 2 is provided to be capable of controlling a flow rate of the refrigerant flowing in the plurality of first heat transfer tubes 11. LEV 2 is connected with a control device (not shown), and is provided such that its degree of opening can be changed by a control signal from the control device.

Second distribution unit 24, 25, 26 connects the second ends of the plurality of first heat transfer tubes 11 and the fourth ends of the plurality of second heat transfer tubes 12. Second distribution unit 24, 25, 26 includes a third distributor 24, a fourth distributor 25, and an inlet and outlet portion 26. First distribution unit 20 and second distribution unit 24, 25, 26 are provided to face each other with heat exchanger main body unit 1 being sandwiched therebetween in direction C. In refrigeration cycle apparatus 200, first distribution unit 20 is disposed below in the vertical direction relative to second distribution unit 24, 25, 26.

Third distributor 24 is connected with the second ends of the plurality of first heat transfer tubes 11. Third distributor 24 is provided to extend along first direction A. The plurality of first heat transfer tubes 11 are connected to third distributor 24 such that the plurality of first heat transfer tubes 11 are in parallel with one another, and third distributor 24 is provided to be capable of distributing the refrigerant to the plurality of first heat transfer tubes 11.

Fourth distributor 25 is connected with the fourth ends of the plurality of second heat transfer tubes 12. Fourth distributor 25 is provided to extend along first direction A. The plurality of second heat transfer tubes 12 are connected to fourth distributor 25 such that the plurality of second heat transfer tubes 12 are in parallel with one another, and fourth distributor 25 is provided to be capable of distributing the refrigerant to the plurality of second heat transfer tubes 12.

Inlet and outlet portion 26 is located between a connection portion between third distributor 24 and the plurality of first heat transfer tubes 11, and a connection portion between fourth distributor 25 and the plurality of second heat transfer tubes 12, and is provided to allow the refrigerant to flow in and out between third distributor 24 and fourth distributor 25.

At the time of cooling operation and defrosting operation, second distribution unit 24, 25, 26 acts as a bifurcating tube which distributes the refrigerant flowing through refrigeration cycle apparatus 200 into third distributor 24 and fourth distributor 25 in outdoor heat exchanger 100, and also acts as a distributor which distributes the refrigerant distributed into third distributor 24 and fourth distributor 25 to the plurality of first heat transfer tubes 11 and the plurality of second heat transfer tubes 12, respectively.

Next, heat exchanger main body unit 1 will be described with reference to FIG. 3. As described above, heat exchanger main body unit 1 includes the plurality of first heat transfer tubes 11, the plurality of second heat transfer tubes 12, and the plurality of fins 13. The plurality of first heat transfer tubes 11 are provided such that two first heat transfer tubes 11 adjacent to each other in first direction A face each other with one fin 13 being sandwiched therebetween. The plurality of second heat transfer tubes 12 are provided such that two second heat transfer tubes 12 adjacent to each other in first direction A face each other with one fin 13 being sandwiched therebetween in first direction A. Each first heat transfer tube 11 and each second heat transfer tube 12 are disposed at a distance from each other along second direction B crossing first direction A. In refrigeration cycle apparatus 200, the plurality of first heat transfer tubes 11 are located on windward side relative to the plurality of second heat transfer tubes 12.

The plurality of first heat transfer tubes 11 each have the same structure, for example. The plurality of second heat transfer tubes 12 each have the same structure, for example. The plurality of fins 13 each have the same structure, for example. First heat transfer tubes 11 and second heat transfer tubes 12 are formed to extend along direction C. First heat transfer tubes 11 and second heat transfer tubes 12 are provided to have flat outer shapes when fins 13 are viewed in plan view (outer shapes of cross sections orthogonal to direction C). In first direction A, a width of first heat transfer tube 11 is equal to a width of second heat transfer tube 12. In second direction B, a width of first heat transfer tube 11 is narrower than a width of second heat transfer tube 12. In second direction B, the width of first heat transfer tube 11 is less than or equal to half of a width of fin 13, and the width of second heat transfer tube 12 is more than or equal to half of the width of fin 13. Fin 13 is constituted as a corrugated fin formed of a thin plate made of metal or the like having a wavelike shape, for example.

Figure 3:
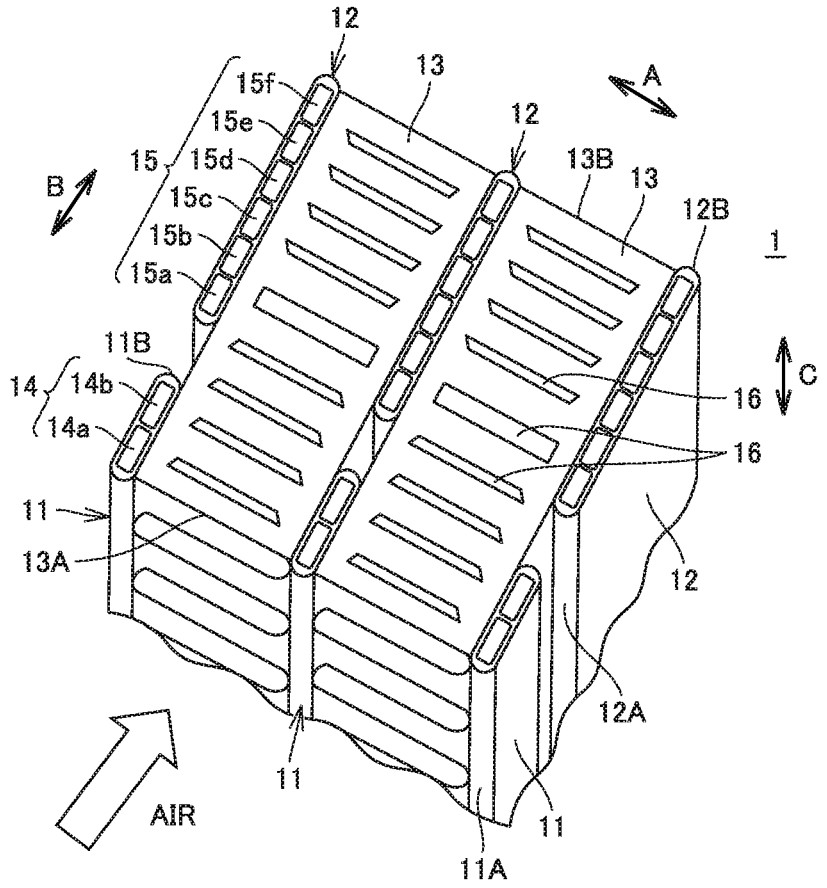
FIG. 3 is a partially enlarged view of the heat exchanger shown in FIG. 2.

As shown in FIG. 3, side ends 11A of first heat transfer tubes 11 located outside in second direction B and side ends 13A of fins 13 located outside in second direction B are provided to lie in the same plane in first direction A, for example. Side ends 12B of second heat transfer tubes 12 located outside in second direction B and side ends 13B of fins 13 located outside in second direction B are provided to lie in the same plane in first direction A, for example. Side ends 12A of second heat transfer tubes 12, which are located opposite to side ends 12B in second direction B and face first heat transfer tubes 11 with a distance therebetween, are provided to be located on the side ends 13A side of fins 13 relative to the center of fins 13 in second direction B.

As shown in FIG. 3, a plurality of through holes 14 extending from the first ends to the second ends are formed in the plurality of first heat transfer tubes 11. A plurality of through holes 15 extending from the third ends to the fourth ends are formed in the plurality of second heat transfer tubes 12. Through holes 14 include two through holes 14*a* and 14*b*, for example. Through holes 15 include six through holes 15*a*, 15*b*, 15*c*, 15*d*, 15*e*, and 15*f*, for example.

As shown in FIG. 3, through holes 14*a* and 14*b* and through holes 15*a*, 15*b*, 15*c*, 15*d*, 15*e*, and 15*f* have an equal width in first direction A, for example. The plurality of through holes 14*a* and 14*b* and through holes 15*a*, 15*b*, 15*c*, 15*d*, 15*e*, and 15*f* have an equal width in second direction B, for example. Through holes 14*a* and 14*b* are disposed to be spaced from each other in second direction B. Through holes 15*a*, 15*b*, 15*c*, 15*d*, 15*e*, and 15*f* are disposed to be spaced from one another in second direction B. Cross sections orthogonal to direction C of through holes 14*a* and 14*b* and through holes 15*a*, 15*b*, 15*c*, 15*d*, 15*e*, and 15*f* may have any shape, and for example, have a rectangular shape. The plurality of through holes 14*a* and 14*b* are each connected with first distributor 21 and third distributor 24, and are provided such that the refrigerant can flow therethrough. The plurality of through holes 15*a*, 15*b*, 15*c*, 15*d*, 15*e*, and 15*f* are each connected with second distributor 22 and fourth distributor 25, and are provided such that the refrigerant can flow therethrough.

As shown in FIG. 3, a total sum S1 of areas of the cross sections orthogonal to direction C of the plurality of through holes 14*a* and 14*b* formed inside the plurality of first heat transfer tubes 11 is less than or equal to a total sum S2 of areas of the cross sections orthogonal to direction C of the plurality of through holes 15*a*, 15*b*, 15*c*, 15*d*, 15*e*, and 15*f* formed inside the plurality of second heat transfer tubes 12. A total sum W1 of the widths in second direction B of the plurality of through holes 14*a* and 14*b* formed inside the plurality of first heat transfer tubes 11 is less than or equal to a total sum W2 of the widths in second direction B of the plurality of through holes 15*a*, 15*b*, 15*c*, 15*d*, 15*e*, and 15*f* formed inside the plurality of second heat transfer tubes 12.

As shown in FIG. 3, the sum of the areas of the cross sections orthogonal to direction C of through holes 14*a* and 14*b* formed inside two first heat transfer tubes 11 facing each other with one fin 13 being sandwiched therebetween is less than or equal to the sum of the areas of the cross sections orthogonal to direction C of through holes 15*a*, 15*b*, 15*c*, 15*d*, 15*e*, and 15*f* formed inside two second heat transfer tubes 12 provided at a distance from two first heat transfer tubes 11, respectively, in second direction B. The sum of the widths in second direction B of through holes 14*a* and 14*b* formed inside two first heat transfer tubes 11 facing each other with one fin 13 being sandwiched therebetween is less than or equal to the sum of the widths in second direction B of through holes 15*a*, 15*b*, 15*c*, 15*d*, 15*e*, and 15*f* formed inside two second heat transfer tubes 12 provided at a distance from two first heat transfer tubes 11, respectively, in second direction B. Preferably, two first heat transfer tubes 11 and two second heat transfer tubes 12 facing each other with each fin 13 being sandwiched therebetween are provided such that they each satisfy the relations described above.

Figure 4:
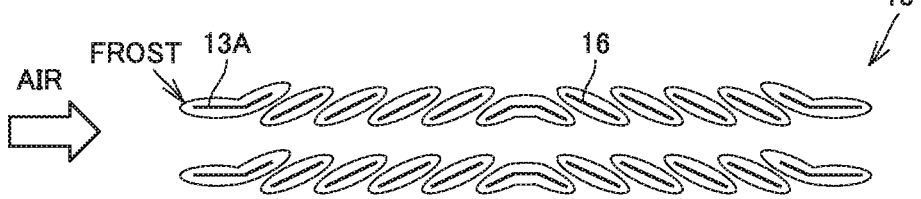
FIG. 4 is a cross sectional view for illustrating a fin of the heat exchanger shown in FIG. 3.

As shown in FIG. 3, fin 13 is connected with both first heat transfer tubes 11 and second heat transfer tubes 12. Fin 13 is fixed to first heat transfer tubes 11 and second heat transfer tubes 12 by brazing, for example. A plurality of louvers 16 are formed in a portion of fin 13 located between portions connected with first heat transfer tubes 11 and between portions connected with second heat transfer tubes 12. The plurality of louvers 16 are formed, for example, to extend along first direction A, and are formed to be spaced from one another in second direction B. Referring to FIGS. 3 and 4, louvers 16 are provided such that, for example, those located on the side end 13A side relative to the center in second direction B and those located on the side end 13B side relative to the center in second direction B are line-symmetric.

<Operation of Refrigeration Cycle Apparatus>

Next, operation of refrigeration cycle apparatus 200 and outdoor heat exchanger 100 will be described with reference to FIG. 1. First, operation of refrigeration cycle apparatus 200 and outdoor heat exchanger 100 at the time of heating operation will be described. At the time of heating operation, refrigeration cycle apparatus 200 constitutes the refrigerant flow path indicated by the solid line and arrows F1 in FIG. 1. The refrigerant in a gas-liquid two-phase state condensed by indoor heat exchanger 5 and expanded by expansion valve 6 is supplied to first distribution unit 20 of outdoor heat exchanger 100. In outdoor heat exchanger 100, a refrigerant flow path extending from first distribution unit 20 to second distribution unit 24, 25, 26 through heat exchanger main body unit 1 is formed.

On this occasion, LEV 2 is completely closed to close between first distributor 21 and inlet and outlet portion 23. Accordingly, at the time of heating operation, a flow of the refrigerant passing through first distributor 21, the plurality of first heat transfer tubes 11, and third distributor 24 in outdoor heat exchanger 100 is closed by LEV 2. By means of LEV 2, only a refrigerant flow path passing through second distributor 22, the plurality of second heat transfer tubes 12, and fourth distributor 25 is formed in outdoor heat exchanger 100 at the time of heating operation. Thereby, in heat exchanger main body unit 1, the refrigerant flowing through through holes 15 in second heat transfer tubes 12 exchanges heat with the outdoor air blown by fan 7 from the first heat transfer tubes 11 side toward the second heat transfer tubes 12 side, via second heat transfer tubes 12 and fins 13.

Figure 5:
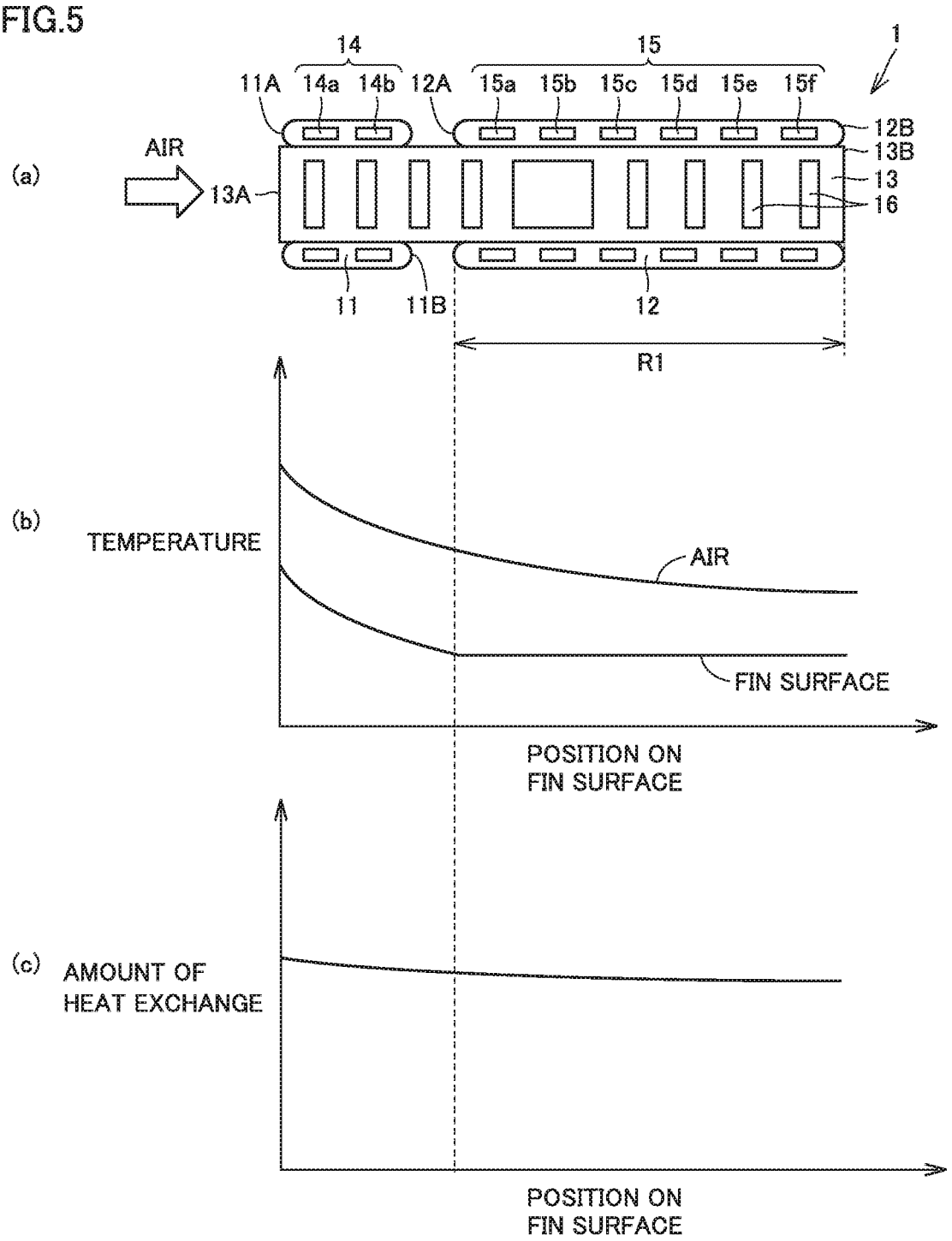
FIG. 5(*a*) is a plan view showing one fin and two first and second heat transfer tubes respectively adjacent to each other with the fin being sandwiched therebetween, in the heat exchanger shown in FIG. 3.

Referring to FIG. 5(*a*) and FIG. 5(*b*), at the time of heating operation, a partial region R1 of fin 13 sandwiched between second heat transfer tubes 12 adjacent to each other is cooled down by the refrigerant flowing through through holes 15 in second heat transfer tubes 12, to a temperature which is nearly equal to the temperature of the refrigerant. Accordingly, in the partial region, a surface temperature of fin 13 exhibits a uniform temperature distribution. It should be noted that the partial region of fin 13 is a region located between a portion aligned with side ends 12A located on the first heat transfer tubes 11 side (windward side) of second heat transfer tubes 12 in first direction A (see FIG. 3) and a portion aligned with side ends 12B in first direction A. On the other hand, in another region of fin 13 sandwiched between first heat transfer tubes 11 adjacent to each other and located on the first heat transfer tubes 11 side (windward side) relative to the partial region, the refrigerant does not flow through through holes 14 in first heat transfer tubes 11, and the other region is apart from second heat transfer tubes 12 through which the refrigerant flows, when compared with the partial region. Accordingly, in the other region, the surface temperature of fin 13 exhibits temperature distribution according to the distance from second heat transfer tubes 12. That is, the surface temperature of fin 13 exhibits temperature distribution in which the surface temperature is highest at side end 13A of fin 13 located farthest from side ends 12A of second heat transfer tubes 12, and gradually decreases toward a position aligned with side ends 12A of second heat transfer tubes 12 in first direction A.

Referring to FIG. 5(*b*), at the time of heating operation, temperature of air passing over a surface of fin 13 which exhibits temperature distribution as described above is higher than the surface temperature of fin 13, and exhibits temperature distribution in which the temperature of the air gradually decreases from the side end 13A side (windward side) toward the side end 13B side (leeward side) of fin 13. It should be noted that, in FIG. 5(*b*), the axis of ordinates represents the temperature of the surface of fin 13 or the air passing over the surface, and the axis of abscissas represents the position on the surface of fin 13 (distance from side end 13A of fin 13 (side ends 11A of first heat transfer tubes 11) in second direction B (see FIG. 3)). In FIG. 5(*c*), the axis of ordinates represents the amount of heat exchange between the refrigerant and the air via fin 13, and the axis of abscissas represents the position on the surface of fin 13 (distance from side end 13A of fin 13 (side ends 11A of first heat transfer tubes 11) in second direction B (see FIG. 3)).

Since the surface temperature of fin 13 and the temperature of the air passing over the surface of fin 13 exhibit the temperature distributions shown in FIG. 5(*b*), the amount of heat exchange between the refrigerant and the outside air via fin 13 exhibits a substantially uniform distribution from side end 13A to side end 13B of fin 13, as shown in FIG. 5(*c*). Thereby, at the time of heating operation, the amount of frost formation on fin 13 can be substantially uniformized from side end 13A to side end 13B of fin 13, as shown in FIG. 4.

Next, operation of refrigeration cycle apparatus 200 and outdoor heat exchanger 100 at the time of defrosting operation (at the time of cooling operation) will be described. At the time of cooling operation and defrosting operation, refrigeration cycle apparatus 200 constitutes the refrigerant flow path indicated by the broken line and arrows F2 in FIG. 1. The refrigerant in a gas single-phase state evaporated by indoor heat exchanger 5 and compressed by compressor 3 is supplied to second distribution unit 24, 25, 26 of outdoor heat exchanger 100. In outdoor heat exchanger 100, a refrigerant flow path extending from second distribution unit 24, 25, 26 to first distribution unit 20 through heat exchanger main body unit 1 is formed.

Figure 6:
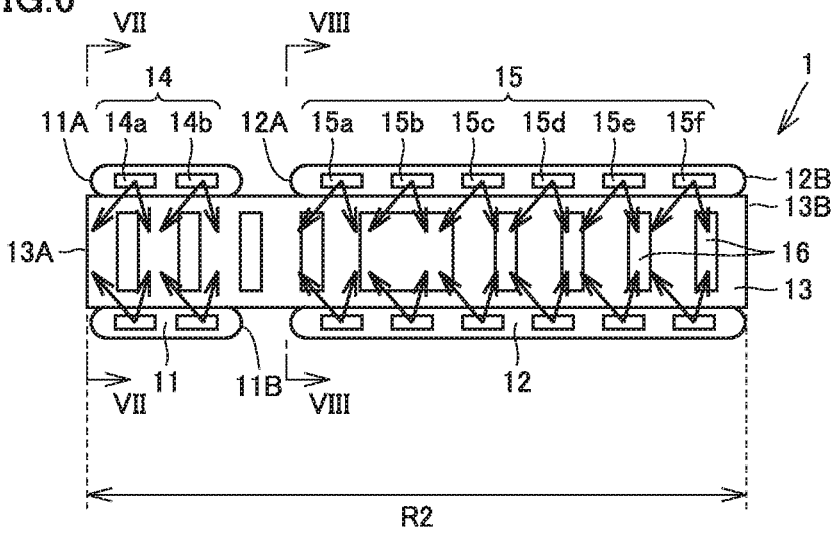
FIG. 6 is a plan view showing a heat exchange state at the time of defrosting operation in the heat exchanger shown in FIG. 5(*a*).

On this occasion, LEV 2 is completely opened. Accordingly, at the time of defrosting operation (at the time of cooling operation), a refrigerant flow path passing through third distributor 24, the plurality of first heat transfer tubes 11, and first distributor 21, and a refrigerant flow path passing through fourth distributor 25, the plurality of second heat transfer tubes 12, and second distributor 22 are simultaneously formed in outdoor heat exchanger 100. Referring to FIG. 6, fin 13 is provided such that side end 13A and side end 13B in second direction B are respectively aligned with side ends 11A of first heat transfer tubes 11 and side ends 12B of second heat transfer tubes 12 in first direction A. Accordingly, at the time of defrosting operation, heat of the refrigerant flowing through through holes 14 in first heat transfer tubes 11 and through holes 15 in second heat transfer tubes 12 is also effectively transferred to the vicinity of side end 13A and side end 13B of fin 13. That is, at the time of defrosting operation, the heat of the refrigerant flowing through through holes 14 in first heat transfer tubes 11 and through holes 15 in second heat transfer tubes 12 is effectively transferred to an entire region R2 of fin 13.

Further, a partial region of fin 13 located on the side end 13A side relative to the center in second direction B is in contact with neither first heat transfer tubes 11 nor second heat transfer tubes 12. However, the partial region is sandwiched between a region adjacent to through holes 14*b* in the first heat transfer tubes 11 and a region adjacent to through holes 15*a* in second heat transfer tubes 12, in second direction B. Accordingly, at the time of defrosting operation, the heat of the refrigerant flowing through through holes 14 in first heat transfer tubes 11 and through holes 15 in second heat transfer tubes 12 is also effectively transferred to the partial region of fin 13 which is not in contact with first heat transfer tubes 11 and second heat transfer tubes 12.

Figure 7:
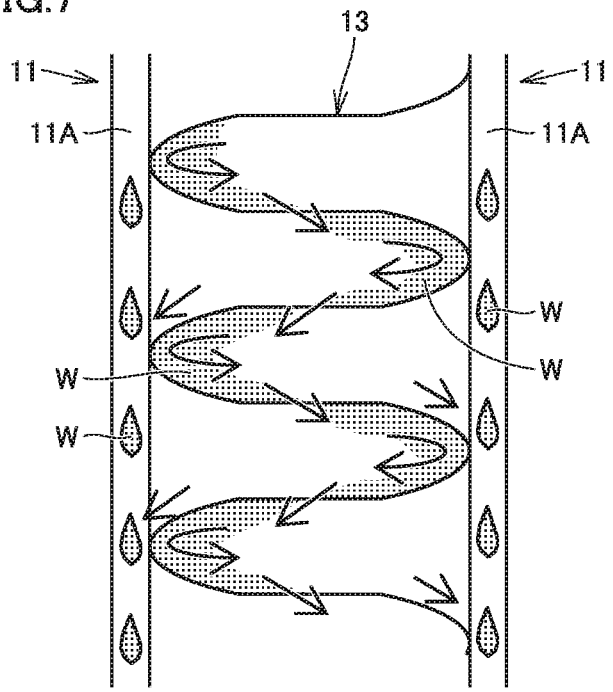
FIG. 7 is an end view in a line segment VII-VII in FIG. 6.
Figure 8:
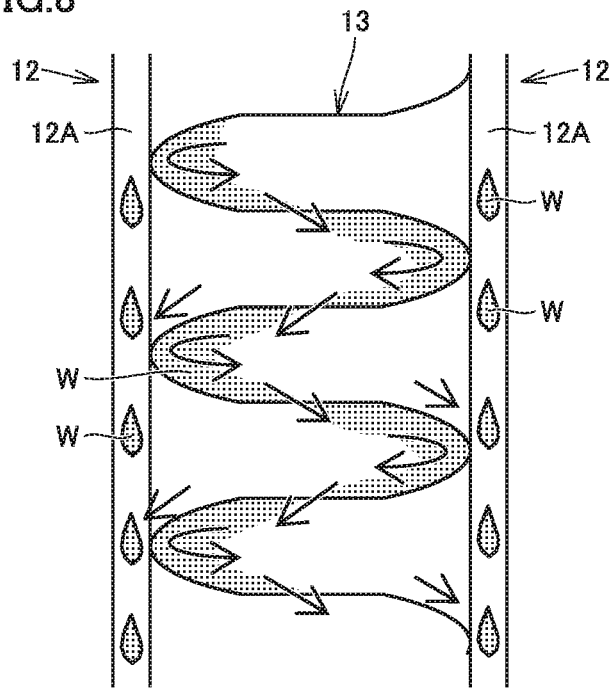
FIG. 8 is an end view in a line segment VIII-VIII in FIG. 6.

Referring to FIGS. 7 and 8, frost melted by the defrosting operation described above turns into water W and is drained and removed from outdoor heat exchanger 100. Outdoor heat exchanger 100 has two drain paths for defrosted frost. One drain path is a drain path directed from above to below in the vertical direction through the surface of fin 13 and louvers 16. Another drain path is a drain path directed from above to below in the vertical direction through side ends 11A, 11B, 12A, 12B in second direction B of first heat transfer tubes 11 and second heat transfer tubes 12.

Function and Effect

Next, the function and effect of outdoor heat exchanger 100 and refrigeration cycle apparatus 200 will be described. Outdoor heat exchanger 100 includes: the plurality of first heat transfer tubes 11 disposed at intervals in first direction A; the plurality of second heat transfer tubes 12 disposed at a distance from the plurality of first heat transfer tubes 11 to face the plurality of first heat transfer tubes 11 in second direction B crossing first direction A, and located on leeward side relative to the plurality of first heat transfer tubes 11; the plurality of fins 13 connecting first heat transfer tubes 11 adjacent to each other and connecting second heat transfer tubes 12 adjacent to each other; first distribution unit 20 connecting the first ends of the plurality of first heat transfer tubes 11 and the third ends of the plurality of second heat transfer tubes 12; and second distribution unit 24, 25, 26 connecting the second ends of the plurality of first heat transfer tubes 11 and the fourth ends of the plurality of second heat transfer tubes 12. First distribution unit 20 includes LEV 2 for controlling the flow rate of the refrigerant flowing in the plurality of first heat transfer tubes 11.

A conventional outdoor heat exchanger is provided such that only two heat transfer tubes are disposed to face each other with one corrugated fin being sandwiched therebetween, and both ends of each heat transfer tube are aligned with both ends of the fin in a flow direction of air. Accordingly, at the time of heating operation, a surface temperature of the entire fin is cooled down by refrigerant to a constant temperature, and a temperature difference between temperature of the air and the surface temperature of the fin increases toward windward side. As a result, in the conventional outdoor heat exchanger, the amount of heat exchange between the refrigerant and the air via the fin increases on the windward side when compared with leeward side, and the amount of frost formation increases in particular on the windward side. Further, in such a conventional outdoor heat exchanger, since the amount of frost formation increases in particular on the windward side, the speed of melting frost at the time of defrosting operation decreases on the windward side when compared with the leeward side. As a result, the conventional outdoor heat exchanger has a poor energy efficiency at the time of defrosting operation. Furthermore, in the heat exchanger described in PTD 1, it is not possible to efficiently defrost frost on the corrugated fin located on the windward side.

In contrast, in outdoor heat exchanger 100, at the time of heating operation of refrigeration cycle apparatus 200, a state in which the refrigerant flows in only the plurality of second heat transfer tubes 12 without flowing in the plurality of first heat transfer tubes 11 can be realized by LEV 2. Thereby, at the time of heating operation, the amount of heat exchange between the refrigerant and the outside air via fin 13 exhibits a substantially uniform distribution from side end 13A to side end 13B of fin 13 (see FIG. 5(*c*)). As a result, frost formation on fin 13 on the windward side can be suppressed, and the amount of frost formation on fin 13 can be substantially uniformized from side end 13A to side end 13B of fin 13.

Further, in outdoor heat exchanger 100, at the time of defrosting operation and cooling operation of refrigeration cycle apparatus 200, a state in which the refrigerant flows in both first heat transfer tubes 11 and second heat transfer tubes 12 can be realized. As a result, at the time of defrosting operation, the heat of the refrigerant flowing through first heat transfer tubes 11 and second heat transfer tubes 12 can be effectively transferred to frost substantially uniformly forming on fin 13 from the windward side to the leeward side at the time of heating operation described above, via entire fin 13. Accordingly, in outdoor heat exchanger 100, the speed of melting frost is equal on the windward side and on the leeward side, and thus outdoor heat exchanger 100 has a high defrosting efficiency. Further, outdoor heat exchanger 100 has a high heat exchange efficiency at the time of cooling operation.

In addition, the conventional outdoor heat exchanger described above has a poor drain efficiency due to a limited drain path for frost melted by defrosting operation. For example, in the conventional heat exchanger provided such that only two heat transfer tubes are disposed to face each other with one corrugated fin being sandwiched therebetween, and both ends of each heat transfer tube are aligned with both ends of the fin in the flow direction of the air, only a drain path directed from above to below in the vertical direction through folded portions of the fin and louvers is formed in a region other than ends on the windward side and on the leeward side. Further, since the region is sandwiched between the two heat transfer tubes, water is likely to stagnate at connection portions between the fin and the heat transfer tubes included in the drain path. In addition, in the heat exchanger described in PTD 1, two drain paths are formed in the corrugated fin protruding on the windward side relative to the heat transfer tubes. That is, there are formed a drain path directed from above to below in the vertical direction through louvers, and a drain path directed from above to below in the vertical direction through a surface of the fin. However, the two drain paths are both formed on the fin, and water is likely to stagnate therein.

In contrast, in outdoor heat exchanger 100, at least three drain paths are formed. That is, there are formed a drain path directed from above to below in the vertical direction through louvers 16 in fin 13, a drain path directed from above to below in the vertical direction through side ends 11A of first heat transfer tubes 11 and side ends 12B of second heat transfer tubes 12, and a drain path directed from above to below in the vertical direction through side ends 11B of first heat transfer tubes 11 and side ends 12A of second heat transfer tubes 12. Since the drain paths directed from above to below in the vertical direction through side ends 11A, 11B, 12A, 12B in second direction B of first heat transfer tubes 11 and second heat transfer tubes 12 have a distance shorter than that of a drain path formed on fin 13, and water is less likely to stagnate therein, the drain paths can drain much water in a short time. As a result, outdoor heat exchanger 100 has defrosting efficiency higher than that of the conventional heat exchanger described above. Further, outdoor heat exchanger 100 can shorten time required for defrosting when compared with the conventional heat exchanger described above. Accordingly, in outdoor heat exchanger 100, even when heating operation is resumed after defrosting operation, water stagnating on the fin without being drained at the time of defrosting operation can be suppressed from turning into frost again, and heat exchange efficiency after heating operation is resumed can be increased when compared with the conventional heat exchanger described above.

Refrigeration cycle apparatus 200 includes outdoor heat exchanger 100, and fan 7 configured to blow gas to outdoor heat exchanger 100 along second direction B. In refrigeration cycle apparatus 200, outdoor heat exchanger 100 is disposed such that first heat transfer tubes 11 are located on the windward side in a flow direction of the air produced by fan 7, and second heat transfer tubes 12 are located on the leeward side. Accordingly, since refrigeration cycle apparatus 200 includes outdoor heat exchanger 100 which suppresses frost formation at the time of heating operation as described above, refrigeration cycle apparatus 200 has a high heat exchange efficiency at the time of heating operation. Further, since refrigeration cycle apparatus 200 includes outdoor heat exchanger 100 having a high defrosting efficiency as described above, refrigeration cycle apparatus 200 can shorten time for defrosting operation, and has a high heat exchange efficiency after heating operation is resumed.

Second Embodiment

Figure 9:
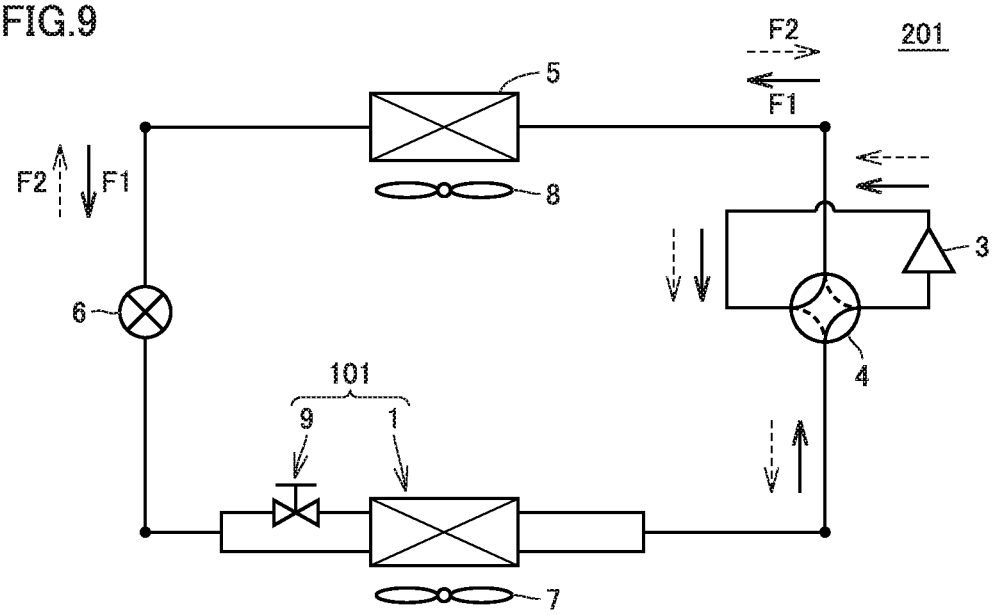
FIG. 9 is a view showing a heat exchanger and a refrigeration cycle apparatus in accordance with a second embodiment.

Next, an outdoor heat exchanger 101 and a refrigeration cycle apparatus 201 in accordance with a second embodiment will be described with reference to FIG. 9. Although outdoor heat exchanger 101 in accordance with the second embodiment has basically the same configuration as that of outdoor heat exchanger 100 (see FIG. 1) in accordance with the first embodiment, outdoor heat exchanger 101 is different from outdoor heat exchanger 100 in that the flow rate control unit is not an LEV but a solenoid valve 9. Although refrigeration cycle apparatus 201 in accordance with the second embodiment has basically the same configuration as that of refrigeration cycle apparatus 200 (see FIG. 1) in accordance with the first embodiment, refrigeration cycle apparatus 201 is different from refrigeration cycle apparatus 200 in that refrigeration cycle apparatus 201 includes outdoor heat exchanger 101 instead of outdoor heat exchanger 100 (see FIG. 1).

Also with such a configuration, solenoid valve 9 is provided to be capable of controlling the flow rate of the refrigerant flowing in the plurality of first heat transfer tubes 11. Accordingly, in outdoor heat exchanger 101, at the time of heating operation of refrigeration cycle apparatus 201, the state in which the refrigerant flows in only the plurality of second heat transfer tubes 12 without flowing in the plurality of first heat transfer tubes 11 can be realized by solenoid valve 9. As a result, outdoor heat exchanger 101 can produce the same effect as that of outdoor heat exchanger 100. Further, refrigeration cycle apparatus 201 can produce the same effect as that of refrigeration cycle apparatus 200.

Further, solenoid valve 9 can control the flow rate of the refrigerant flowing in first heat transfer tubes 11 by turning on/off an electric signal (opening/closing solenoid valve 9). That is, solenoid valve 9 can be controlled by a control device having a structure simpler than that of the control device required to control the degree of opening of LEV 2 of outdoor heat exchanger 100 in accordance with the first embodiment. Accordingly, the manufacturing cost of outdoor heat exchanger 101 is lower than that of outdoor heat exchanger 100.

Third Embodiment

Figure 10:
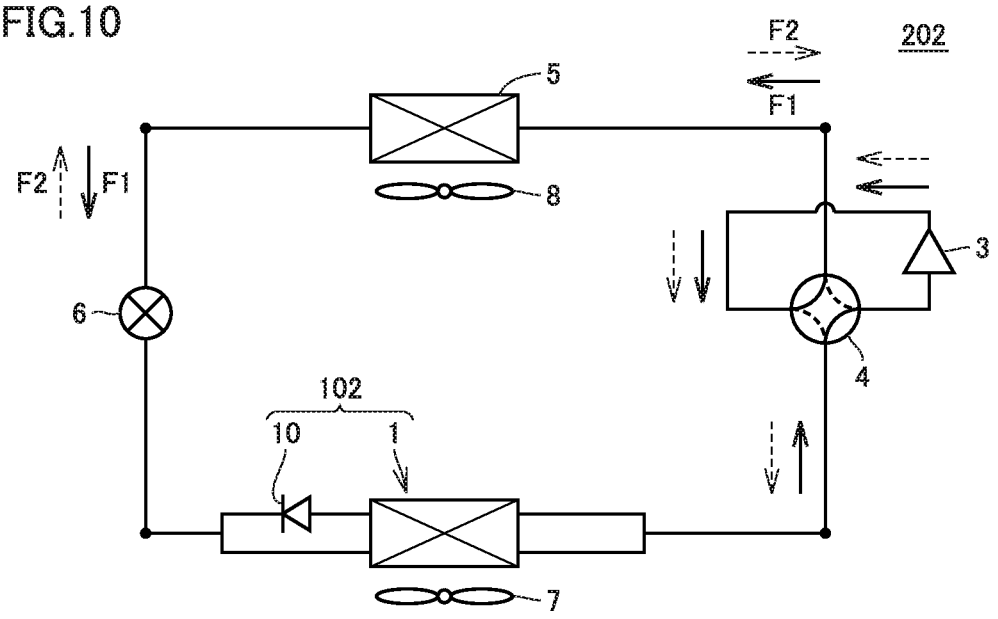
FIG. 10 is a view showing a heat exchanger and a refrigeration cycle apparatus in accordance with a third embodiment.

Next, an outdoor heat exchanger 102 and a refrigeration cycle apparatus 202 in accordance with a third embodiment will be described with reference to FIG. 10. Although outdoor heat exchanger 102 in accordance with the third embodiment has basically the same configuration as that of outdoor heat exchanger 100 (see FIG. 1) in accordance with the first embodiment, outdoor heat exchanger 102 is different from outdoor heat exchanger 100 in that the flow rate control unit is not an LEV but a check valve 10. Although refrigeration cycle apparatus 202 in accordance with the third embodiment has basically the same configuration as that of refrigeration cycle apparatus 200 (see FIG. 1) in accordance with the first embodiment, refrigeration cycle apparatus 202 is different from refrigeration cycle apparatus 200 in that refrigeration cycle apparatus 202 includes outdoor heat exchanger 102 instead of outdoor heat exchanger 100 (see FIG. 1).

Also with such a configuration, check valve 10 is provided to be capable of controlling the flow rate of the refrigerant flowing in the plurality of first heat transfer tubes 11. Accordingly, in outdoor heat exchanger 102, at the time of heating operation of refrigeration cycle apparatus 202, the state in which the refrigerant flows in only the plurality of second heat transfer tubes 12 without flowing in the plurality of first heat transfer tubes 11 can be realized by check valve 10. As a result, outdoor heat exchanger 102 can produce the same effect as that of outdoor heat exchanger 100. Further, refrigeration cycle apparatus 202 can produce the same effect as that of refrigeration cycle apparatus 200.

Further, check valve 10 can limit a flow direction of the refrigerant flowing in first heat transfer tubes 11 to only one direction without using a control signal, an electric signal, or the like. Specifically, check valve 10 closes a flow of the refrigerant directed from inlet and outlet portion 23 toward first heat transfer tubes 11 through first distributor 21 at the time of heating operation, and does not disturb a flow of the refrigerant directed from first heat transfer tubes 11 toward inlet and outlet portion 23 through first distributor 21 at the time of defrosting operation and cooling operation. Accordingly, the manufacturing cost of outdoor heat exchanger 102 is lower than those of outdoor heat exchanger 100 and outdoor heat exchanger 101. Furthermore, since check valve 10 can be mounted in a smaller space when compared with LEV 2 or solenoid valve 9, outdoor heat exchanger 102 can be downsized when compared with outdoor heat exchanger 100 and outdoor heat exchanger 101.

Figure 11:
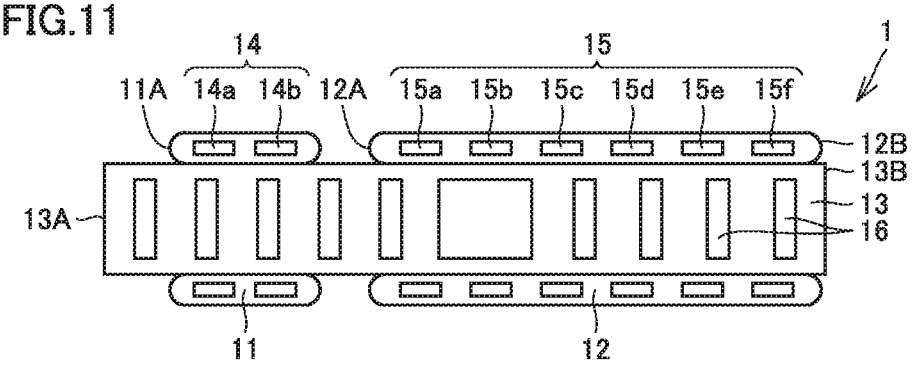
FIG. 11 is a partially enlarged view showing a variation of the heat exchangers in accordance with the first to third embodiments.

It should be noted that, although side ends 11A of first heat transfer tubes 11 and side ends 13A of fins 13 are provided to lie in the same plane in first direction A as shown in FIG. 3 in outdoor heat exchangers 100, 101, and 102 in accordance with the first to third embodiments, the present invention is not limited thereto. Referring to FIG. 11, side end 13A of fin 13 may protrude in second direction B relative to side ends 11A of first heat transfer tubes 11. The distance between side ends 11A of first heat transfer tubes 11 and side end 13A of fin 13 in second direction B may have any value as long as frost on side end 13A can be melted by the heat of the refrigerant flowing through through holes 14 in first heat transfer tubes 11 at the time of defrosting operation, but it is more preferable that the distance is shorter.

Even in such heat exchanger main body unit 1, the surface temperature of fin 13 at the time of heating operation exhibits temperature distribution in which the surface temperature is highest at side end 13A of fin 13 located farthest from side ends 12A of second heat transfer tubes 12, and gradually decreases toward a position aligned with side ends 12A of second heat transfer tubes 12 in first direction A. Further, the temperature of the air passing over the surface of fin 13 at the time of heating operation exhibits temperature distribution in which the temperature of the air gradually decreases from the side end 13A side toward the side end 13B side of fin 13. Accordingly, the amount of frost formation on fin 13 at the time of heating operation can be substantially uniformized from side end 13A to side end 13B of fin 13.

Further, at the time of defrosting operation, the heat of the refrigerant flowing through through holes 15 in second heat transfer tubes 12 is effectively transferred to the vicinity of side end 13B of fin 13. Furthermore, if the distance between side ends 11A of first heat transfer tubes 11 and side end 13A of fin 13 is short, the heat of the refrigerant flowing through through holes 14 in first heat transfer tubes 11 is effectively transferred to the vicinity of side end 13A of fin 13. As a result, an outdoor heat exchanger including heat exchanger main body unit 1 shown in FIG. 11 can produce the same effect as those of outdoor heat exchangers 100, 101, and 102 described above.

Further, although LEV 2, solenoid valve 9, or check valve 10 serving as the flow rate control unit is provided to be capable of switching between a state in which the refrigerant flows in the plurality of first heat transfer tubes 11 and the plurality of second heat transfer tubes 12 (a first state) and a state in which the refrigerant flows in only the plurality of second heat transfer tubes 12 without flowing in the plurality of first heat transfer tubes 11 (a second state) in outdoor heat exchangers 100, 101, and 102 in accordance with the first to third embodiments, the present invention is not limited thereto. The flow rate control unit only has to be provided to be capable of switching between the first state and a second state in which the flow rate of the refrigerant is smaller than that in the first state in only the plurality of first heat transfer tubes 11. That is, the second state which can be realized by the flow rate control unit may be any state in which, when compared with the first state, the flow rate of the refrigerant flowing in the plurality of second heat transfer tubes 12 is not decreased, and only the flow rate of the refrigerant flowing in the plurality of first heat transfer tubes 11 is decreased.

For example, the flow rate control unit can switch between a first state in which the flow rate of the refrigerant flowing in first heat transfer tubes 11 is equal to the flow rate of the refrigerant flowing in second heat transfer tubes 12, and a second state in which the flow rate of the refrigerant flowing in first heat transfer tubes 11 is relatively smaller than the flow rate of the refrigerant flowing in second heat transfer tubes 12. Even in such an outdoor heat exchanger, the flow rate of the refrigerant flowing in first heat transfer tubes 11 at the time of heating operation can be decreased when compared with the conventional outdoor heat exchanger, and thus frost formation on fin 13 on the windward side can be suppressed, and defrosting efficiency can be increased. It should be noted that the state most suitable as the second state is the state in which the refrigerant flows in only the plurality of second heat transfer tubes 12 without flowing in the plurality of first heat transfer tubes 11. Further, when the total flow rate of the refrigerant flowing in the plurality of first heat transfer tubes 11 and the plurality of second heat transfer tubes 12 is constant in the first state and the second state, the second state which can be realized by the flow rate control unit is a state in which, when compared with the first state, the flow rate of the refrigerant flowing in the plurality of first heat transfer tubes 11 is decreased, and the flow rate of the refrigerant flowing in the plurality of second heat transfer tubes 12 is increased.

It should be understood that the embodiments disclosed herein are illustrative and non-restrictive in every respect. The scope of the present invention is defined by the scope of the claims, rather than the description above, and is intended to include any modifications within the scope and meaning equivalent to the scope of the claims.

INDUSTRIAL APPLICABILITY

The present invention is advantageously applicable to a refrigeration cycle apparatus which performs heating operation in a cold climate, and a heat exchanger used for the refrigeration cycle apparatus.

The invention claimed is:

1. A heat exchanger comprising:

a plurality of first heat transfer tubes disposed at intervals in a first direction and having respective first ends and respective second ends, each first heat transfer tube of the plurality of first heat transfer tubes including a plurality of through holes extending from the first end to the second end of each first heat transfer tube;

a plurality of second heat transfer tubes disposed at a distance from the plurality of first heat transfer tubes to face the plurality of first heat transfer tubes in a second direction crossing the first direction, the plurality of second heat transfer tubes being located on leeward side relative to the plurality of first heat transfer tubes and having respective third ends and respective fourth ends, each second heat transfer tube of the plurality of second heat transfer tubes including a plurality of through holes extending from the third end to the fourth end of each second heat transfer tube;

a plurality of fins connecting the first heat transfer tubes adjacent to each other and connecting the second heat transfer tubes adjacent to each other;

each second heat transfer tube of the plurality of second heat transfer tubes having a first side end and a second side end extending in the second direction, the first side end of each second heat transfer tube facing inwardly and toward a corresponding first heat transfer tube of the plurality of first heat transfer tubes and disposed at the distance therefrom, and the second side end of each second heat transfer tube facing outwardly;

a first inlet and outlet portion and a second inlet and outlet portion that allow the refrigerant to flow in and out;

a first distributor assembly connecting the first inlet and outlet portion and the first ends of the plurality of first heat transfer tubes, and connecting the first inlet and outlet portion and the third ends of the plurality of second heat transfer tubes; and a second distributor assembly connecting the second inlet and outlet portion and the second ends of the plurality of first heat transfer tubes, and connecting the second inlet and outlet portion and the fourth ends of the plurality of second heat transfer tubes, the first distributor assembly including a flow rate control valve that switches between a first state and a second state, in the first state, refrigerant flowing in the plurality of first heat transfer tubes and the plurality of second heat transfer tubes, and in the second state, in only the plurality of first heat transfer tubes, a flow rate of the refrigerant being smaller than a flow rate of the refrigerant in the first state.

2. The heat exchanger according to claim 1, wherein the second state is a state in which the refrigerant flows in only the plurality of second heat transfer tubes without flowing in the plurality of first heat transfer tubes.

3. The heat exchanger according to claim 1, wherein the first distributor assembly includes a first distributor connected with the first ends of the plurality of first heat transfer tubes, a second distributor connected with the third ends of the plurality of second heat transfer tubes, and the first inlet and outlet portion located between a first connection portion and a second connection portion, the first connection portion being between the plurality of first heat transfer tubes and the first distributor, the second connection portion being between the plurality of second heat transfer tubes and the second distributor, the first inlet and outlet portion being provided to allow the refrigerant to flow in and out between the first distributor and the second distributor, and the flow rate control valve is provided between the first connection portion and the first inlet and outlet portion.

4. The heat exchanger according to claim 3, wherein the flow rate control valve is a solenoid valve.

5. The heat exchanger according to claim 3, wherein the flow rate control valve is an expansion valve.

6. The heat exchanger according to claim 3, wherein the flow rate control valve is a check valve.

7. The heat exchanger according to claim 1, wherein a total cross sectional area S1 of refrigerant flow paths formed inside the plurality of first heat transfer tubes is less than or equal to a total cross sectional area S2 of refrigerant flow paths formed inside the plurality of second heat transfer tubes.

8. A refrigeration cycle apparatus comprising:

the heat exchanger according to claim 1; and a fan configured to blow gas to the heat exchanger along the second direction.

* * * * *